United States Patent [19]

Descary et al.

[11] 3,977,938

[45] *Aug. 31, 1976

[54] SUPPORT BEAM FOR THE RECTIFIER SECTION OF A HEADBOX

[75] Inventors: John Gilbert Descary, Lachine; Ramamurthy Gopal Krishnan, Montreal, both of Canada

[73] Assignee: Dominion Engineering Works, Limited, Lachine, Canada

[ * ] Notice: The portion of the term of this patent subsequent to Apr. 15, 1992, has been disclaimed.

[22] Filed: Mar. 6, 1975

[21] Appl. No.: 556,118

Related U.S. Application Data

[63] Continuation-in-part of Ser. No. 362,082, May 21, 1973, Pat. No. 3,878,039.

[52] U.S. Cl. ..... 162/343; 162/336; 162/347

[51] Int. Cl.[2] ..... D21F 1/02

[58] Field of Search ..... 162/336, 338, 343, 344, 162/347, 212, 216

[56] References Cited

UNITED STATES PATENTS

| | | | |
|---|---|---|---|
| 3,065,788 | 11/1972 | Beachler et al. | 162/336 |
| 3,313,681 | 4/1967 | Dennis et al. | 162/336 X |
| 3,468,756 | 9/1969 | Villa | 162/344 |
| 3,556,935 | 1/1971 | Amneus et al. | 162/336 X |
| 3,652,391 | 3/1972 | Spengos et al. | 162/343 |
| 3,661,705 | 5/1972 | DeNoyer | 162/343 |
| 3,769,154 | 10/1973 | Wolf | 162/336 X |
| 3,878,039 | 4/1975 | Descary et al. | 162/336 |

*Primary Examiner*—S. Leon Bashore
*Assistant Examiner*—Richard V. Fisher
*Attorney, Agent, or Firm*—Raymond A. Eckersley

[57] ABSTRACT

In a headbox of slender profile having a load bearing structure extending in the cross machine direction located on one side of the headbox rectifier section, load transfer partitions reaching across the depth of the rectifier section connect one wall of the section to the opposite wall in load transfer relation, to transfer pressure loading there-across, so as to maintain the rectifier section in substantially undeformed condition during operation.

3 Claims, 4 Drawing Figures

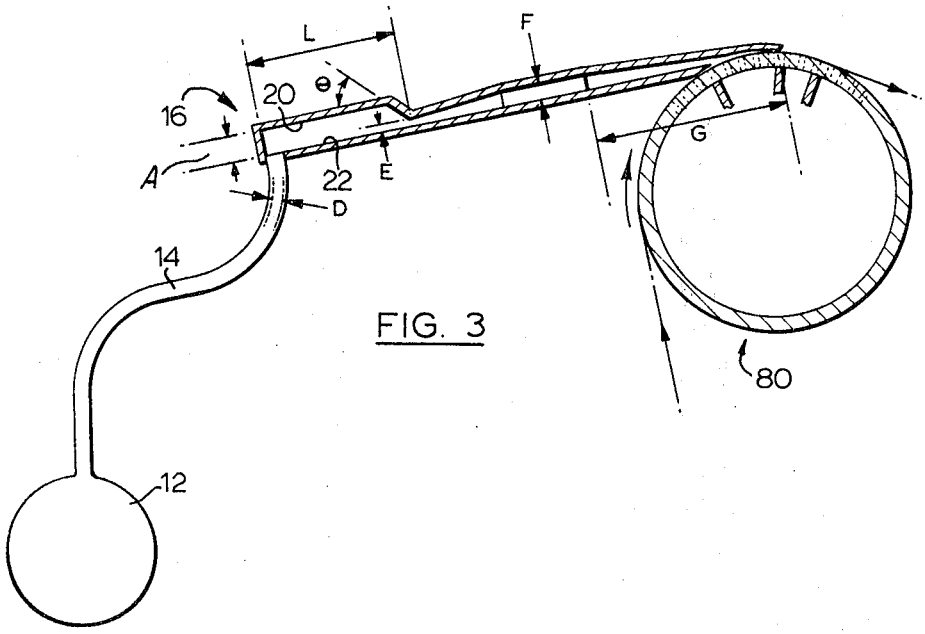
FIG. 3
FIG. 4
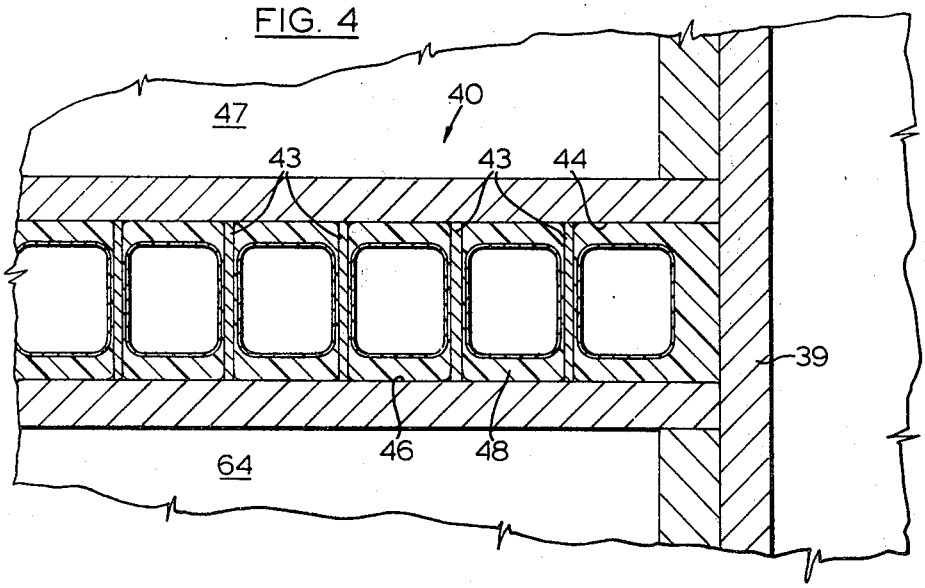

SUPPORT BEAM FOR THE RECTIFIER SECTION OF A HEADBOX

This invention is directed to a headbox rectifier section for use with a web forming machine, such as a paper making machine, and is a continuation in part of Application Ser. No. 362,082 filed May 21, 1973, now U.S. Pat. No. 3,878,039.

Paper making and allied web forming machines utilize head boxes extending across the width of the machine in order to transform a flow of stock conveyed in a pipe by a fan pump into a uniform broad flat stream of controlled turbulence characteristic moving at a substantially uniform velocity for deposition onto a moving wire or between a pair of such wires. The geometry of some machines and stock flow characteristics require the provision of a rectifier section of shallow geometry.

Of the many forms of headbox previously developed, that show in U.S. Pat. No. 3,661,705, May 9, 1972, resembles in some limited aspects the arrangement of the present invention. However, the partitions provided within this headbox do not serve to transfer structural loads, which are accommodated by deep sections and a pneumatic loading provision. Also, being an open topped flow passage, the requirements for dimensional consistency are much less demanding.

In view of the large width of paper machine for which such head boxes rectifier sections may be used, it is important to ensure dimensional stability of the section so so to provide consistently uniform flow characteristic for a reasonable range of headbox operation. One object of the present invention is to provide a form of headbox rectifier section suitable for web forming machines extending up to considerable widths, having reduced head clearance to permit enhanced access to a web forming section, with no loss in structural rigidity.

A further object of the present invention is to provide controlled micro-turbulence to the stock as it passes through the section.

A further object of the present invention is to provide a headbox rectifier section of straightforward design suitable for low cost manufacture.

A further object is the provision of a head box rectifier section providing satisfactory operation over a wide flow range and capable of operating with a number of different stock furnishes, without variation in rectifier section and slice dimensions.

A further object of the present invention is to provide a head box rectifier section possessing structural integrity and suited to the limited space available in twin wire forming machines.

A further object of this invention is the provision of a slender rectifier section having great structural strength in a light structure, to provide predetermined flow characteristic at relatively low cost.

Thus, there is provided in a head box for supplying a stock suspension to a machine slice of a web forming machine at substantially uniform velocity profile, a distributor section to receive stock from a stock supply, a mixing chamber connected to the header and connecting with a rectifier section of shallow depth and great structural integrity, capable of remaining substantially undeformed over a wide range of operating conditions.

Certain embodiments of the present invention are described, reference being made to the accompanying drawing wherein:

FIG. 3 is a similar view of an alternative arrangement of the rectifier section used in conjunction with a single wire machine wet end; and FIG. 4 is a section of the rectifier at 4—4 of FIG. 2.

Figure 1:
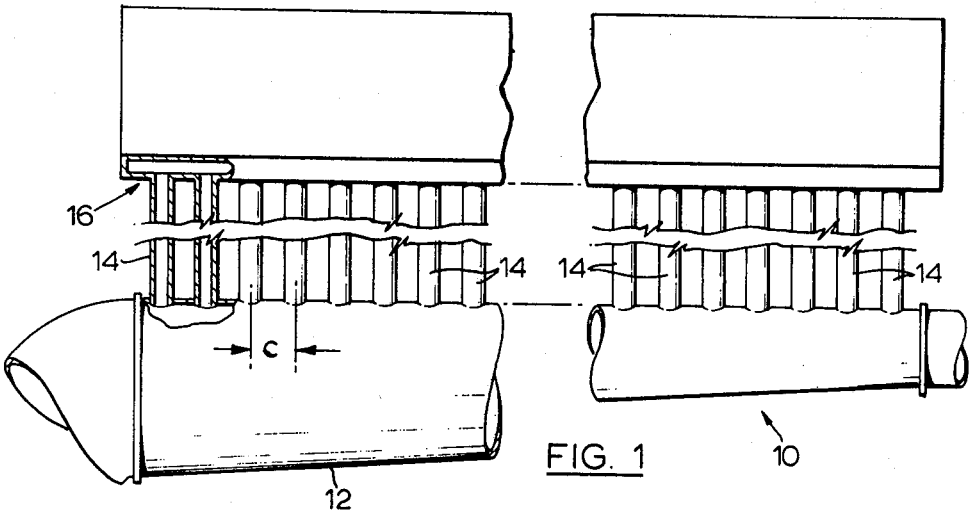
FIG. 1 is a view from the back of a machine showing the connection of a flow header to the headbox.

Referring first to FIG. 1, one suitable headbox arrangement 10 comprises a tapered header 12 extending in the cross-machine direction having a plurality of connection pipes 14 extending upwardly in the present instance to the mixing chamber 16.

The mixing chamber 16 has a back wall 18, a chamber top face 20 and a bottom face 22 spaced therefrom. Reference characters relating to relative dimension proportions will be found in FIGS. 1 and 3.

In the illustrated headbox embodiment the depth of the mixing chamber A, across which the inflowing stock from the connection pipes 14 must flow is related to the length of the mixing chamber L, being in the ratio of 6:1 or greater.

The exit from the mixing chamber 16 is by way of a restriction throat 24 having a depth E which is less than ⅓ of the depth A of the chamber. The convergent portion 26 of the chamber top face 20 which defines the throat 24 is inclined at an angle $\theta$ preferably between 35° and 55°. A value of inclination of about 45° has been found particularly effective.

The stock flow path diverges from the throat 24 into diffuser 30, which joins a rectifier section 40 illustrated as having a constant depth F and a plurality of transversely extending divider walls 42 joining the top plate 44 to the bottom plate 46 thereof by welding in load transfer relation.

The stiffness of the transfer or rectifier section 40 is provided predominantly by an underlying beam structure 50 of considerable depth and great stiffness, particularly in the cross-machine direction, which is generally its major dimension.

The beam structure 50 comprises a bottom plate 62 having a plurality of web plates 64, 66, 68. A front extension 69 carries a lower slice plate 54, while a rear extension 70 carries the inlet header 12. Adjustable front mounts 72 and rear mounts 74 permit the inclination of the headbox and the rectifier section assembly to be varied as required.

The rigidity of the beam structure 50 is transferred across the approach section 40 by the welded plates 43 that comprise a part of the divider walls 42, see FIG. 4, so as to maintain the section dimensionally stable through the full range of working load. Thus the overhead dimensions of the rectifier section can be minimized, so as to permit access to a forming section having a geometry not generally convenient for headbox access.

With reference to the structure illustrated in FIG. 4, the rectifier section 40 has a plurality of steel divider plates 43 extending vertically between and structurally joining the upper and lower faces 44, 46 of the approach section, to provide an adjoining series of rectangular flow paths of great rigidity. The walls 48 of these flow paths may be formed by cast epoxy, having suitable streamline fairings at the upstream and at the downstream ends, to promote smooth flow together with the avoidance of hang-up of the stock at the ends of the dividers 42. It is contemplated that in addition to serving as reinforcement for the stiff structure of substantially non-varying cross-section, the epoxy liners 48 generate a controlled degree of micro-turbulence due to the shearing action of the stock flowing therepast. The depth F of approach section 40 lies between the values A and E of mixing chamber 16.

A side wall 39 encloses the rectifier section.

The rectifier section 40 is provided with a shallow super-structure comprising a flange plate 43 and end plates 45, 47 forming with the upper face 44 a shallow box structure to provide additional stiffness to the rectifier section.

In fabricating the rectifier section 40, the plate members of the structure are assembled and welded together, including the associated portions 64, 66 of the beam structure. Suitable cores (not shown) are then positioned in spaced relation between adjacent ones of the steel divider plates 43, and a metal filled epoxy resin is poured around the cores, to completely line the flow passages of the section 40. Adoption of this method of fabrication permits the use of a standardized rectifier section basic steel structure, with control over the passage size in accordance with the size of core members used.

Figure 2:
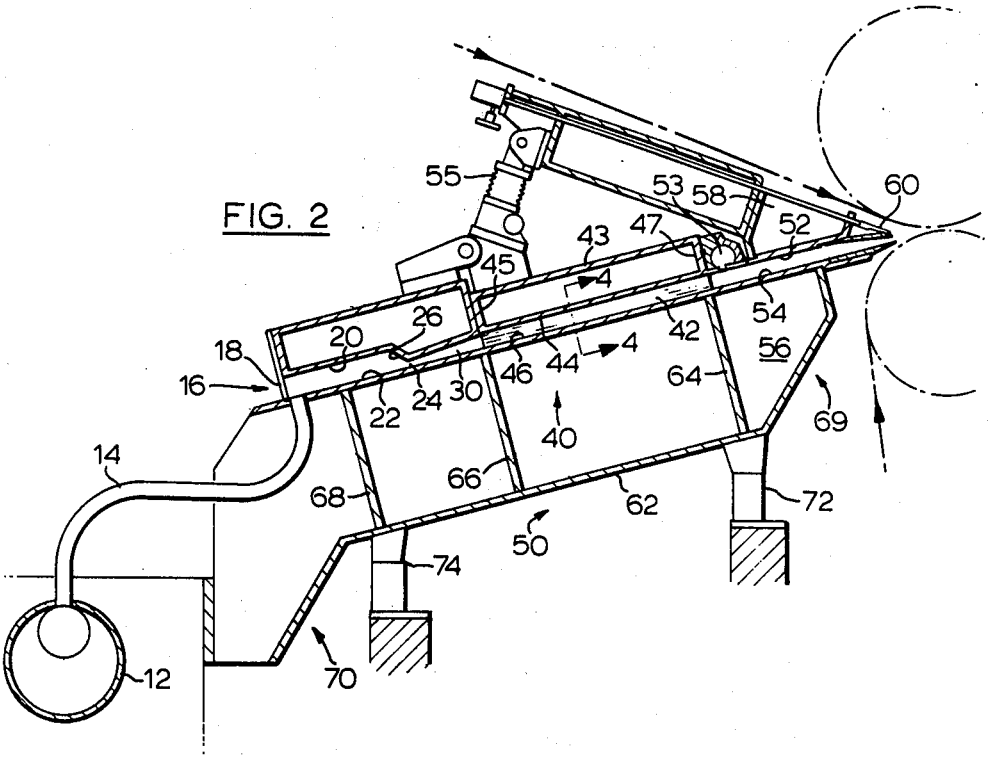
FIG. 2 is a longitudinal section showing a subject rectifier section and a headbox in conjunction with a portion of a twin-wire web forming machine, looking in the cross-machine direction.

In the arrangements illustrated in FIGS. 2 and 3, the length G (see FIG. 3) of the flow channel is such that the turbulence imparted to the stock by the divider walls 42 of the rectifier section 40 can decay at least partially before the lips of the slice are reached.

In one arrangement embodying a rectifier section 40, in which the rectifier section had an internal height of 1.75 inches, the channel length G was made about 25 inches long in order to provide a desired extent of turbulence decay.

Referring to the embodiment illustrated in FIG. 3, this shows the use of a rectifier section according to the present invention with a suitable head box in conjunction with a non-submerged cylinder former 80 suitable for making multi-ply board. A similar rectifier section configuration might also be used in a a tissue former, the wet-end embodiment illustrated in FIG. 2 being shown as having a multi-vacuum forming roll.

The slice 50 comprises an upper plate 52 and a lower plate 54, the plates 52, 54 being attached to the rectifier section 40 to maintain constant the inlet spacing therebetween for all operational flow conditions. The slice 50 has external stiffening members 56, 58 and an adjustable lip 60 to permit control over slice opening, by overall slice adjustment, and by localized control of the slice opening, as is well known in the art. Thus the slice upper wall 52 can be pivoted about the point of attachment 53, by actuation of actuators 55. It will be seen that the benefit of structural rigidity and low head clearance provided by the subject rectifier section is also conveyed to the slice structure, to promote its dimensional stability and resistance to deformation under load.

What we claim as new and desire to secure by Letters Patent of the United States is:

1. Apparatus for use with a paper machine, having a headbox mixing chamber to receive a flow of stock therein for passage of the stock to an outlet slice, in combination with a shallow rectifier section positioned in stock conducting relation between said mixing chamber and said slice, said rectifier section comprising a top section plate and a bottom section plate for conducting said stock therebetween, each said plate extending substantially the full width of the rectifier section, a support beam structure secured to one said plate on the side thereof remote from the other said plate, to provide structural support to said one plate against deflection thereof when the apparatus is in use, and a plurality of load transfer divider wall means positioned across the width of the rectifier section in mutually spaced relation to divide the space between said top and bottom plates into a plurality of substantially parallel flow channels, said divider wall means securing said top plate to said bottom plate in tied, deformation resisting relation along the length of said channels, to transfer the stiffness of said beam structure to the other said plate for substantially the full length of the rectifier section between said mixing chamber and said slice.

2. The apparatus as claimed in claim 1, including means lining said flow channels having predetermined flow characteristics to impart micro turbulence of predetermined extent to said stock flowing through the section.

3. The apparatus as claimed in claim 1 with lip portions of said outlet slice being attached to the outlet side of said rectifier section in load transfer relation therewith, to impart stiffness of said support beam structure in the cross-machine direction so as to provide support to the slice against internal fluid pressure acting on the slice lips.

* * * * *